United States Patent [19]

Munson

[11] 4,361,450

[45] Nov. 30, 1982

[54] PLASTIC BONDED EXPLOSIVE COMPOSITIONS

[75] Inventor: William O. Munson, Brigham City, Utah

[73] Assignee: Thiokol Corporation, Newtown, Pa.

[21] Appl. No.: 584,535

[22] Filed: Jun. 2, 1975

[51] Int. Cl.[3] ..... C06B 45/10

[52] U.S. Cl. ..... 149/19.91; 149/20; 149/38; 149/92; 149/105

[58] Field of Search ..... 149/19.91, 20, 92, 38, 149/105, 78

[56] References Cited

U.S. PATENT DOCUMENTS

| | | | |
|---|---|---|---|
| 2,998,772 | 9/1961 | Land | 149/19.91 X |
| 3,322,583 | 5/1967 | Guthrie et al. | 149/19.91 |
| 3,427,295 | 2/1969 | Reed | 149/19.91 X |
| 3,699,176 | 10/1972 | Syrop | 149/105 X |
| 3,723,202 | 3/1973 | Butler et al. | 149/19.91 X |
| 3,723,204 | 3/1973 | Evans | 149/19.91 |
| 3,755,471 | 8/1973 | Dacons | 149/105 X |
| 3,756,874 | 9/1973 | Chang et al. | 149/92 X |
| 3,770,524 | 11/1973 | Walker et al. | 149/38 X |

*Primary Examiner*—Edward A. Miller

*Attorney, Agent, or Firm*—G. K. White; T. W. Brennan

[57] ABSTRACT

Plastic bonded self-explosive compositions having improved thermal stability consisting essentially of a self-explosive, e.g., hexanitro-stilbene, which exhibit an exotherm as measured by differential thermal analysis at a temperature no lower than 275° C. and a binder which is a polymer of an alkyl methacrylate wherein the alkyl group has 10 to 20 carbon atoms e.g. lauryl methacrylate.

14 Claims, No Drawings

PLASTIC BONDED EXPLOSIVE COMPOSITIONS

This invention relates to plastic bonded explosive compositions having improved temperature resistance.

Broadly speaking, plastic bonded explosives are known in the art and have been previously described and used. Such bonded explosives commonly comprise a crystalline self-explosive such as TNT, RDX or HMX and an organic binder such as a fluorocarbon or silicone binder. In some cases fuels such as aluminum powder and/or oxidizers such as potassium perchlorate have been used to achieve particular properties. These previously known bonded explosives are subject to the disadvantage that they do not have sufficient high temperature stability for certain applications.

More particularly, bombs and other munitions carried by high speed military aircraft and warheads for missiles are subject to aerodynamic heating which tends to affect adversely the properties of explosive compositions contained therein. Standard bomb fillings are currently limited to 80° C. which is the melting point of TNT. Bomb fillings based on RDX are known to be stable to somewhat higher temperatures, i.e., about 140° C. However, the continuing development of higher speed aircraft creates a need for explosive compositions having still better thermal stability. Projected speeds and flight profiles for aircraft indicate that munitions capable of withstanding 230° C. for one hour will be required to permit full exploitation of aircraft capabilities.

It is accordingly an object of the present invention to provide an explosive composition having improved thermal stability. It is another object of the invention to provide an explosive composition comprising a self-explosive and a compatible plastic binder, which composition remains stable at substantially higher temperatures than the bonded explosives previously available. Other objects of the invention will be in part obvious and in part pointed out hereafter.

The present invention is based on the discovery that a bonded explosive having exceptionally good thermal stability can be achieved by formulating an explosive composition consisting essentially of a self-explosive which exhibits an exotherm, as measured by differential thermal analysis, at a temperature no lower than 275°C., and a binder which is a polymer of an alkyl methacrylate wherein the alkyl group has 10 to 20 carbon atoms. It has been found that such compositions are capable of withstanding temperatures of 230° C. or higher for periods of one hour or longer.

Self-explosives which exhibit an exotherm at a temperature no lower than 275° C. and which are therefore suitable for use in the present compositions include 2,2',4,4',6,6'-hexanitrostilbene (HNS); (3-picryl amino-1,2,4-triazole (PATO); 2,6-bis-(picryl amino)-3,5-dinitrobenzene (PYX); and 2,4,6-triamino-1,3,5-trinitrobenzene (TATB). Illustrative physical properties of these self-explosives are given in Table I below. In the Table the values for the onset of an exotherm were determined by Differential Thermal Analysis (DTA) using a procedure such as that described in Chapter 3 of "Thermal Analysis" by A. Blazek published by Van Nostrand & Reinhold, London (1973). The Vacuum Thermal Stability (VTS) figures were obtained by the procedure described at pages 1-5 to 1-9 of Volume 4 of "Joint Service Safety and Performance Manual for Qualification of Explosives for Military Use" published by Naval Weapons Center, China Lake, Calif. (1971).

TABLE I

| | HNS | PYX | TATB | PATO |
|---|---|---|---|---|
| Crystal Density (g/cc) | 1.74 | 1.77 | 1.94 | 1.90 |
| Melting point (°C.) | 316-318 | 360 | 340 | 283 |
| Onset of Exotherm DTA (°C.) | 312 | 310 | 320 | 283 |
| VTS at 320° C. (cc/g/hr) | 0.5 | 0.5 | 1.04 | — |
| VTS at 260° C. (cc/g/hr) | 0.3 | 0.297 | 0.247 | 0.66 |

As indicated above, the binder is desirably a polymer of a long chain alkyl methacrylate, e.g., lauryl methacrylate or stearyl methacrylate, made by polymerization of the monomer in the presence of a free radical catalyst, such as e.g., benzoyl peroxide. The binder may be a homopolymer of the long chain alkyl acrylate or a copolymer with minor amounts of such comonomers tertiary butyl styrene or mono-chlorostyrene and optionally, a cross-linker such as triethylene glycol diacrylate and/or a processing aid such as propylene glycol monoacrylate. While I do not wish to be bound by any theory as to the mode of operation of the present compositions, it appears that the thermal stability of the binder of the present compositions may be due, at least in part, to the fact that such a polymer has a robust carbon-carbon linked backbone which is inherently relatively stable to oxidative or thermal degradation. Also it is probable that the long pendant alkyl groups of the polymer contribute to its thermal stability and chemical inertness. While the alkyl methacrylate can be used in monomer form in preparing the present compositions, better mixing has been achieved by first partially polymerizing the alkyl methacrylate to a syrup having a viscosity of say 200 to 1,000 centipoises before mixing it with the self-explosive and other constituents of the formulation.

While the present compositions may comprise only the alkyl methacrylate and self-explosive, in most cases preferred results are obtained by also incorporating in the composition aluminum powder as a fuel and an inorganic oxidizer such as potassium perchlorate or sodium nitrate. The preferred proportions of the four ingredients are 9% to 30% by weight of binder, 10% to 87% of self-explosive, 0 to 20% of aluminum and 0 to 60% of potassium perchlorate or sodium nitrate.

In accordance with a preferred method of preparing the present formulations, a suitable mixer is charged with the methacrylate monomer, and if used, the comonomer or comonomers, cross-linking agent and processing aid. After these binder ingredients have been mixed, the self-explosive in particulate form is added in two batches with intermediate mixing. Thereafter the oxidizer and/or aluminum powder are added and incorporated in the mixture. Lastly, the free radical catalyst, e.g., benzoyl peroxide, is added in an amount of about 0.5 to 2% by weight of the binder and thoroughly mixed with the other ingredients.

The mixture as thus prepared is charged into a desired container such as a bomb casing, or otherwise cast to a desired configuration, and cured at an elevated temperature of say 50° to 75° C. Curing is usually effected over a period of 1 to 10 days.

It has been found that bonded explosive compositions as thus prepared remain stable at temperatures of upwards of 250° C. as indicated by the onset of an exotherm as determined by Differential Thermal Analysis.

Also their vacuum thermal stability as measured by the above-identified test procedure is less than 2 cc/gram/-hour at 230° C. Thus these compositions exhibit exceptional thermal stability.

In order to point out more fully the nature of the present invention, a number of illustrative formulations embodying the present invention, together with some of the properties thereof, are given in Table II below. In the Table the quantities of ingredients are expressed as parts by weight.

TABLE II

| Ingredients | A | B | C | D | E | F |
|---|---|---|---|---|---|---|
| Lauryl Methacrylate | 17 | 17 | 17 | 17 | 17.5 | 17.5 |
| HNS | 83 | 73 | 63 | 63 | 50 | 50 |
| $KClO_4$ | — | 10 | — | — | 12.5 | — |
| $NaNO_3$ | — | — | 20 | 20 | 20 | 20 |
| Al | — | — | — | 20 | 20 | 20 |
| End of mix viscosity, kilopoise/°C. | 27/41 | 19/38 | 10/41 | 15/38 | 40/36 | 4/41 |
| Mix temperature, °C. | 41 | 38 | 41 | 38 | 36 | 41 |
| Cure temperature, °C. | 57 | 57 | 57 | 57 | 57 | 57 |
| Cure time, hr. | 72 | 72 | 48 | 48 | 48 | 72 |
| Density, g/cc | 1.50 | 1.51 | 1.47 | 1.56 | 1.61 | 1.60 |
| Detonation rate, m/s | 7,000 | 6,070 | 5,280 | D | 5 450 | 5,770 |
| Onset of exotherm DTA (°C.) | 265 | 265 | 256 | 267 | — | 265 |
| VTS at 230° C. cc/g/hr | 0.68 | 1.00 | 1.09 | 0.89 | — | 1.23 |

As indicated above, the binder of the present compositions may be a copolymer of the alkyl methacrylate and a minor amount of a comonomer. The properties of a number of compositions of this type are given in Table III below. In these compositions the principal monomer was lauryl methacrylate, the compositions comprised 25% by weight each of binder/catalyst, HNS, potassium perchlorate, and aluminum powder. The catalyst was 1% of benzoyl peroxide.

TABLE III

| Property | t-butyl styrene 0% | t-butyl styrene 5% | t-butyl styrene 10% | 5% mono-chloro styrene |
|---|---|---|---|---|
| Percent weight loss, 2 hr. at 230° C. | 0.716 | 0.681 | 0.850 | 0.714 |
| VTS at 230° C. cc/g/hr. | 0.840 | 0.695 | 0.730 | |
| Onset of exotherm DTA (°C.) | 263 | 257 | 250 | |

The compositions of Table IV below illustrate and compare the results obtained when using stearyl methacrylate and lauryl methacrylate binders. These compositions comprised 25% by weight each of binder/-catalyst, HNS, potassium perchlorate and aluminum powder. The catalyst was 0.35% of benzoyl peroxide.

TABLE IV

| Ingredient | A | B | C | D | E | F |
|---|---|---|---|---|---|---|
| Stearyl methacrylate | 24.65 | — | 23.40 | — | 23.15 | — |
| Lauryl methacrylate | — | 24.65 | — | 23.40 | — | 23.15 |
| t-butyl styrene | — | — | 1.25 | 1.25 | 1.25 | 1.25 |
| Triethylene glycol diacrylate | — | — | — | — | 0.125 | 0.125 |
| Propylene glycol monoacrylate | — | — | — | — | 0.125 | 0.125 |
| % wt. loss, 2 hrs. at 230° C. | 0.945 | 0.808 | 0.850 | 0.750 | 0.905 | 0.699 |

TABLE IV-continued

| Ingredient | A | B | C | D | E | F |
|---|---|---|---|---|---|---|
| VTS at 230° C. cc/g/hr. | 0.933 | 0.984 | 0.777 | — | 0.807 | 0.820 |
| Onset of exotherm DTA (°C.) | 260 | 263 | 260 | 263 | 260 | 255 |
| Shore A hardness, Before heating | 60 | 32 | 55 | 56 | 66 | 64 |
| After heating at 230° C. | 73 | 53 | 74 | 63 | 74 | 73 |

The data given in Table V below illustrate the results obtained with compositions comprising 50 weight % of lauryl methacrylate binder and 50 weight % of several different self-explosives.

TABLE V

| Self-explosive | Onset of Exotherm DTA (°C.) |
|---|---|
| HNS | 255 |
| PATO | 282 |
| PYX | 296 |
| TATB | 306 |

From the foregoing examples of formulations embodying the present invention it should be evident that such formulations provide bonded self-explosives having exceptionally high thermal stability. It is, of course, to be understood that the examples are intended to be illustrative only and that numerous changes can be made in the ingredients, proportions and conditions disclosed without departing from the spirit of the invention as defined in the appended claims.

I claim:

1. A plastic bonded explosive composition consisting essentially of a self-explosive which exhibits an exotherm as measured by differential thermal analysis at a temperature no lower than 275° C., said self-explosive being selected from the group consisting of 2,2',4,4',6,6'-hexanitrostilbene; 2,6-bis-(picrylamino)-3,5-dinitrobenzene; 2,4,6-amino-1,3,5-trinitrobenzene; and 3-picylamino-1,2,4-triazole, and a binder which is a polymer of an alkyl methacrylate wherein the alkyl group has 10 to 20 carbon atoms.

2. A plastic bonded explosive composition according to claim 1 wherein said binder is a polymer or copolymer of lauryl methacrylate.

3. A plastic bonded explosive composition according to claim 1 wherein said binder is a polymer or copolymer of stearyl methacrylate.

4. A plastic bonded explosive composition consisting essentially of 70% to 91% by weight of a self-explosive which exhibits an exotherm as measured by differential thermal analysis at a temperature no lower than 275° C., said self-explosive being selected from the group consisting of 2,2',4,4',6,6'-hexanitrostilbene; 2,6-bis-(picrylamino)-3,5-dinitrobenzene; 2,4,6-amino-1,3,5-trinitrobenzene; and 3-picrylamino-1,2,4-triazole, and from 9% to 30% by weight of a binder which is a polymer of an alkyl methacrylate wherein the alkyl group has 10 to 20 carbon atoms.

5. A plastic bonded explosive composition according to claim 4 wherein said binder is a polymer or copolymer of lauryl methacrylate.

6. A plastic bonded explosive composition consisting essentially of from 10% to 87% by weight of a self-explosive which exhibits an exotherm as measured by differential thermal analysis at a temperature no lower than 275° C., said self-explosive being selected from the group consisting of 2,2',4,4',6,6'-hexanitrostilbene; 2,6-bis-(picrylamino)-3,5-dinitrobenzene; 2,4,6-amino-1,3,5-trinitrobenzene; and 3-picrylamino-1,2,4-triazole, from 9% to 30% of a binder which is a polymer of an alkyl methacrylate wherein the alkyl group has 10 to 20 carbon atoms, from 0 to 20% of aluminum powder and from 0 to 60% of an inorganic particulate oxidizer.

7. A plastic bonded explosive composition according to claim 6 wherein said binder is a polymer or copolymer of lauryl methacrylate.

8. A plastic composition according to claim 6 wherein said inorganic oxidizing agent is potassium perchlorate.

9. A plastic bonded explosive composition according to claim 6 wherein said self-explosive is a hexanitro-stilbene.

10. A plastic bonded explosive composition consisting essentially of 10% to 87% by weight of a hexanitrostilbene, 9% to 30% of a binder which is a lauryl methacrylate polymer or copolymer 0 to 20% of aluminum powder and 0 to 60% of potassium perchlorate.

11. A plastic bonded explosive composition consisting essentially of a self-explosive which is 2,2',4,4',6,6'-hexanitrostilbene and a binder which is a polymer of an alkyl methacrylate wherein the alkyl group has 10 to 20 carbon atoms.

12. A plastic bonded explosive composition consisting essentially of a self-explosive which is 2,6-bis-(picrylamino)-3,5-dinitrobenzene and a binder which is a polymer of an alkyl methacrylate wherein the alkyl group has 10 to 20 carbon atoms.

13. A plastic bonded explosive composition consisting essentially of a self-explosive which is 2,4,6-amino-1,3,5-trinitrobenzene and a binder which is a polymer of an alkyl methacrylate wherein the alkyl group has 10 to 20 carbon atoms.

14. A plastic bonded explosive composition consisting essentially of a self-explosive which is 3-picrylamino-1,2,4-triazole and a binder which is a polymer of an alkyl methacrylate wherein the alkyl group has 10 to 20 carbon atoms.

* * * * *